US007235085B1

(12) United States Patent
Tahir

(10) Patent No.: US 7,235,085 B1
(45) Date of Patent: Jun. 26, 2007

(54) HAIR REMOVAL APPARATUS

(76) Inventor: Shaheen F. Tahir, P.O. Box 122, Hammondsport, NY (US) 14840

( * ) Notice: Subject to any disclaimer, the term of this patent is extended or adjusted under 35 U.S.C. 154(b) by 346 days.

(21) Appl. No.: 10/951,045

(22) Filed: Sep. 27, 2004

(51) Int. Cl.
*A61B 17/50* (2006.01)
*A22B 5/08* (2006.01)

(52) U.S. Cl. ..... 606/133; 606/131; 452/82

(58) Field of Classification Search ..... 606/133, 606/131; 452/82–86, 91; 19/2; 69/20, 26; 30/34.2, 42, 45, 46
See application file for complete search history.

(56) References Cited

U.S. PATENT DOCUMENTS 4,825,867 A 5/1989 Gross et al.
4,899,748 A * 2/1990 Gross ..... 606/133
4,983,175 A * 1/1991 Daar et al. ..... 606/133
5,312,419 A 5/1994 Garenfeld et al.
5,643,287 A * 7/1997 Ahad ..... 606/133
D409,333 S 5/1999 Gudefin
5,908,425 A * 6/1999 Adam ..... 606/133
5,951,573 A * 9/1999 Yashar ..... 606/133
6,176,862 B1 1/2001 Delay et al.
2003/0014059 A1 1/2003 Caoduro

FOREIGN PATENT DOCUMENTS

EP 00360253 A2 * 9/1989

* cited by examiner

*Primary Examiner*—Glenn K. Dawson
*Assistant Examiner*—Amanda Adams

(57) ABSTRACT

A hair removal apparatus includes a housing that has a front wall, a back wall and a peripheral wall. The front wall has an aperture extending therethrough. A pair of spools is rotatably mounted in the housing. Biasing members rotationally bias the spools in opposite directions with respect to each other. A first tether is wound around a first of the spools and a second tether is wound around a second of the spools. The first and second tethers are wound about each other to form loops positioned adjacent to the apertures. The biasing members pull the tethers taut. A drive assembly mechanically coupled to the first and second spools selectively moves the first and second spools. The loops twist with respect to each other when the first and second spools are move in the first and second directions. The loops engage and remove hair attached to skin.

7 Claims, 6 Drawing Sheets

HAIR REMOVAL APPARATUS

BACKGROUND OF THE INVENTION

1. Field of the Invention

The present invention relates to hair removing devices and more particularly pertains to a new hair removing device for pulling hair out of the skin at the roots.

2. Description of the Prior Art

The use of hair removing, or depilatory, devices is known in the prior art. U.S. Pat. No. 4,899,748 describes a device for rotating hair plucking bodies that have slits therein that opened and closed as the plucking bodies are rotated. The slits pull hair out of skin as they are moved across the skin. Another type of hair removing device is U.S. Pat. No. 4,983,175 having a pair of strings wound about each other and about gears. As the gears rotate, the portions of the strings wound together are capable of pulling out hair as they are moved over skin.

While these devices fulfill their respective, particular objectives and requirements, the need remains for a device that utilizes tethers wound about each other to form loops which are alternately tightened and loosed adjacent to a skin receiving area. As the loops are loosened and tightened, they rotate such that they may entangle with and pull out hair that is attached to skin positioned in the skin receiving area.

SUMMARY OF THE INVENTION

The present invention meets the needs presented above by generally comprising a housing that has a front wall, a back wall and a peripheral wall extending between the front and back walls. The front wall has an aperture extending therethrough. A pair of spools is rotatably mounted in the housing and positioned so that the aperture is between the spools. Each of the spools has a rotational axis orientated parallel with respect to each other. Biasing members rotationally bias the spools in opposite directions with respect to each other. A first tether is wound around a first spool of the pair of spools. The first tether has a free end secured adjacent to a second spool of the pair of spools. A second tether is wound around the second spool. The second tether extends away from the second spool and is wound about the first tether and to define a plurality of loops. The loops are positioned adjacent to the aperture. A free end of the second tether is secured adjacent to the first spool. The biasing members pull the first and second tethers taut. A drive assembly is mechanically coupled to the first and second spools for selectively moving the first and second spools in a first direction away from each other. The biasing members move the first and second spools in a second direction toward each other. The loops twist with respect to each other when the first and second spools move in the first and second directions. The loops may be selectively positioned against skin so that the loops engage and remove hair attached to the skin.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

The objects of the invention, along with the various features of novelty which characterize the invention, are pointed out with particularity in the claims annexed to and forming a part of this disclosure.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
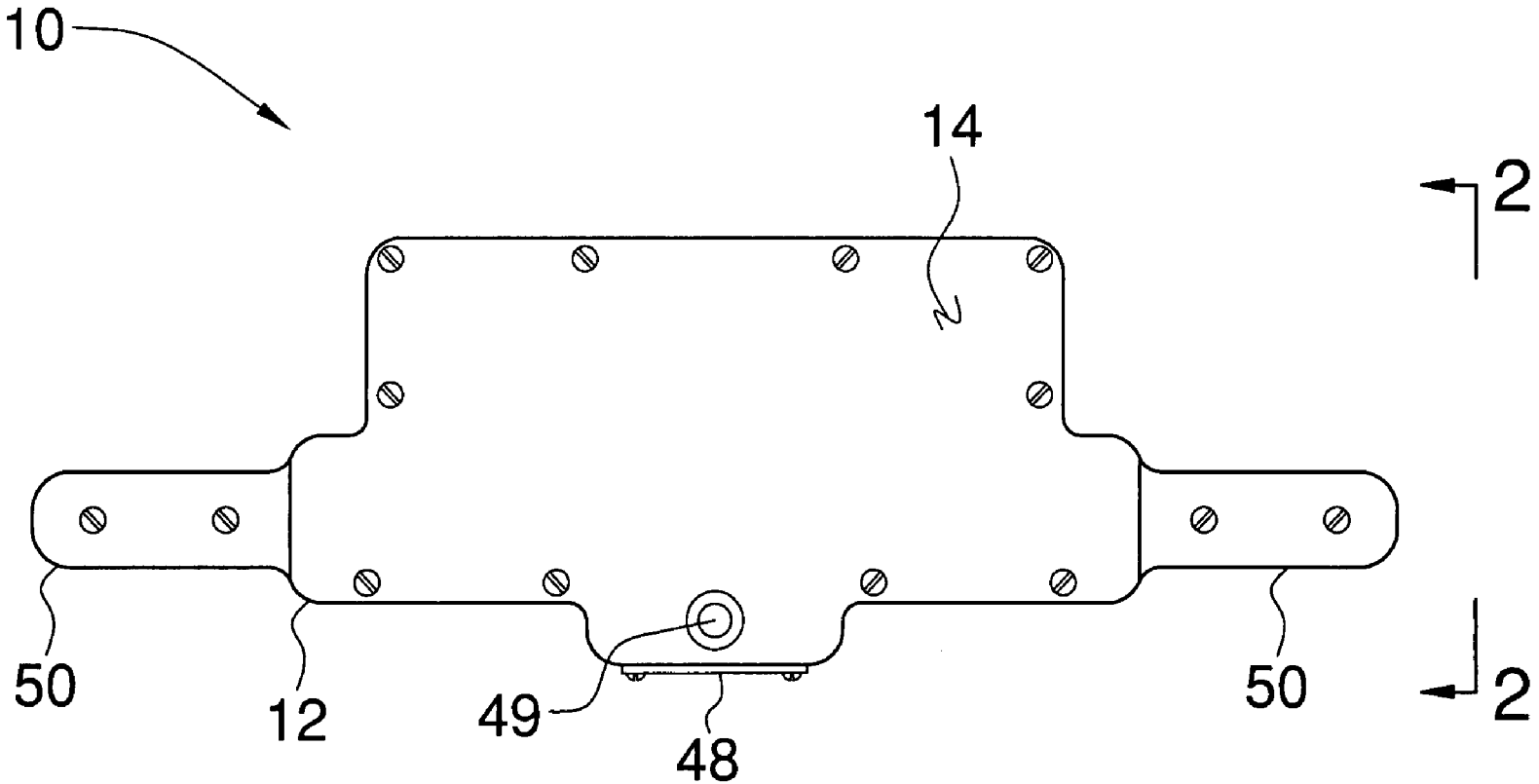
FIG. 1 is a rear view of a hair removal apparatus according to the present invention.
Figure 2:
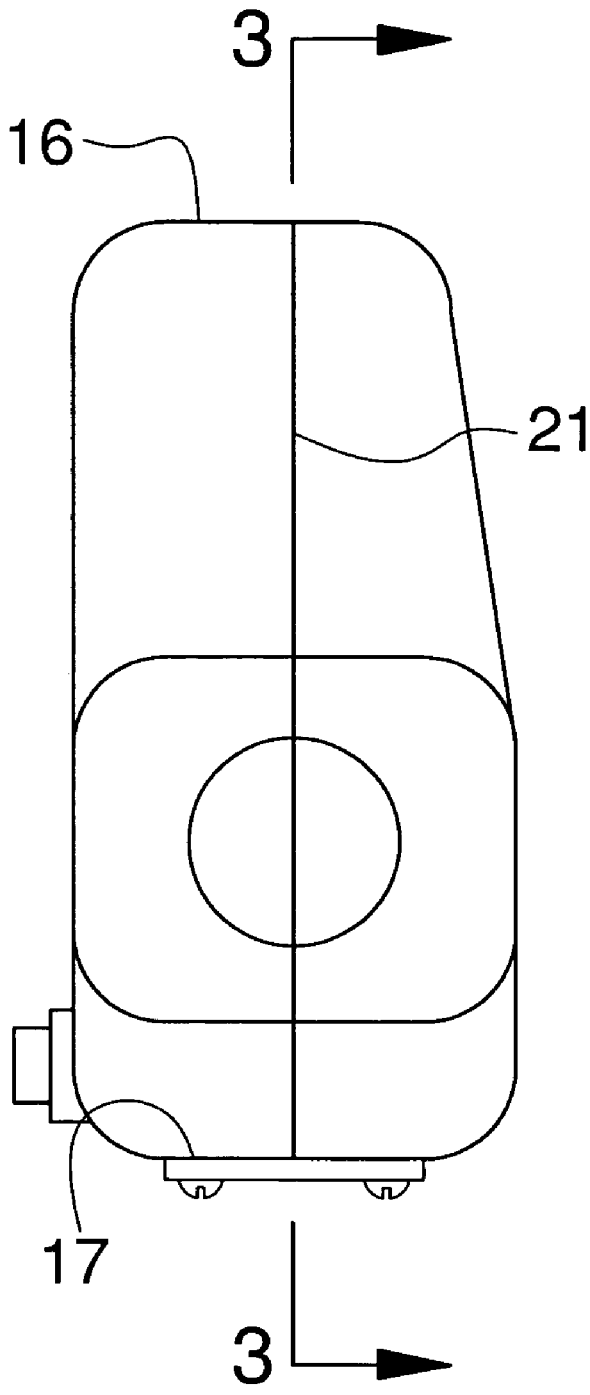
FIG. 2 is a side view of the present invention.
Figure 3:
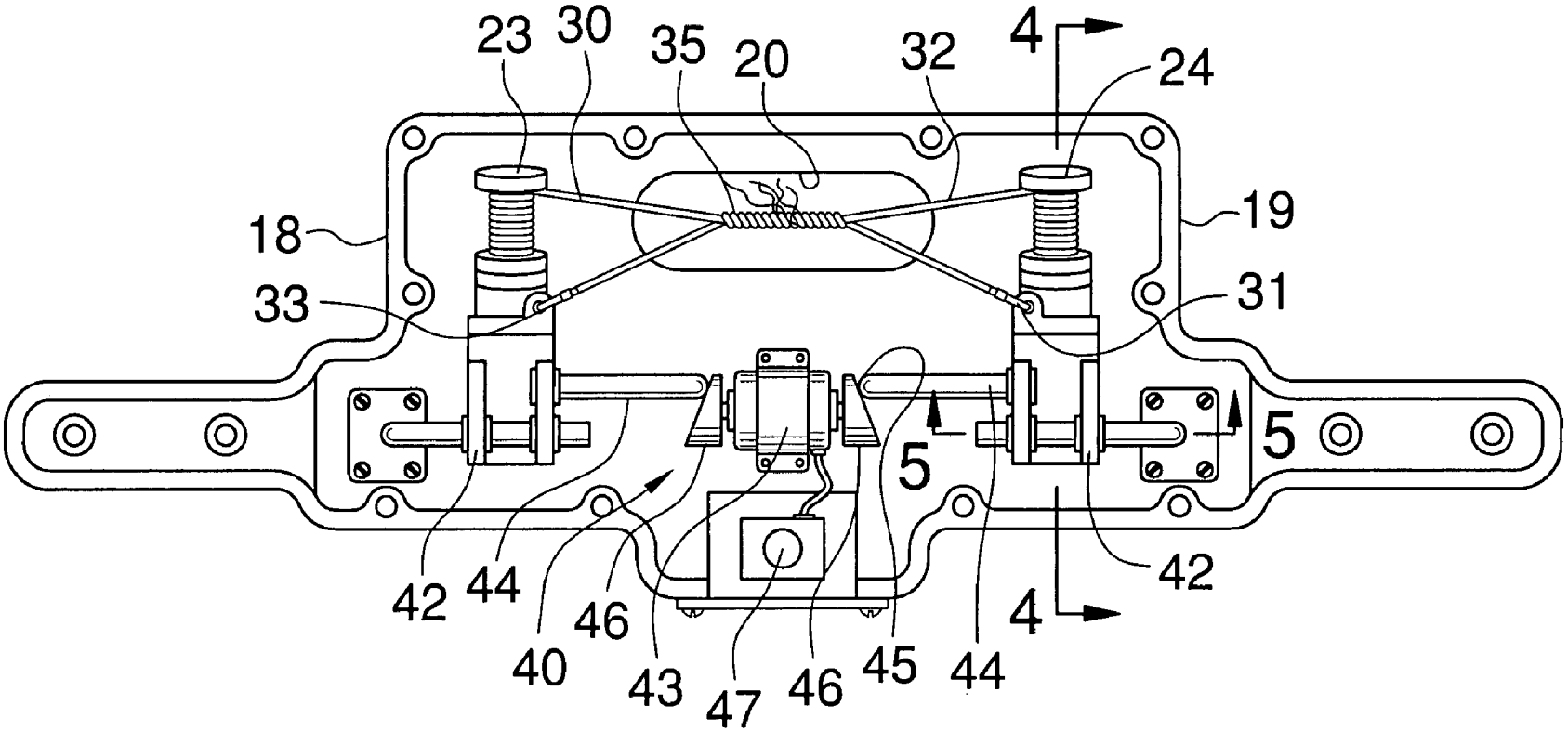
FIG. 3 is a cross-sectional view taken along line 3-3 of FIG. 2 of the present invention.
Figure 4:
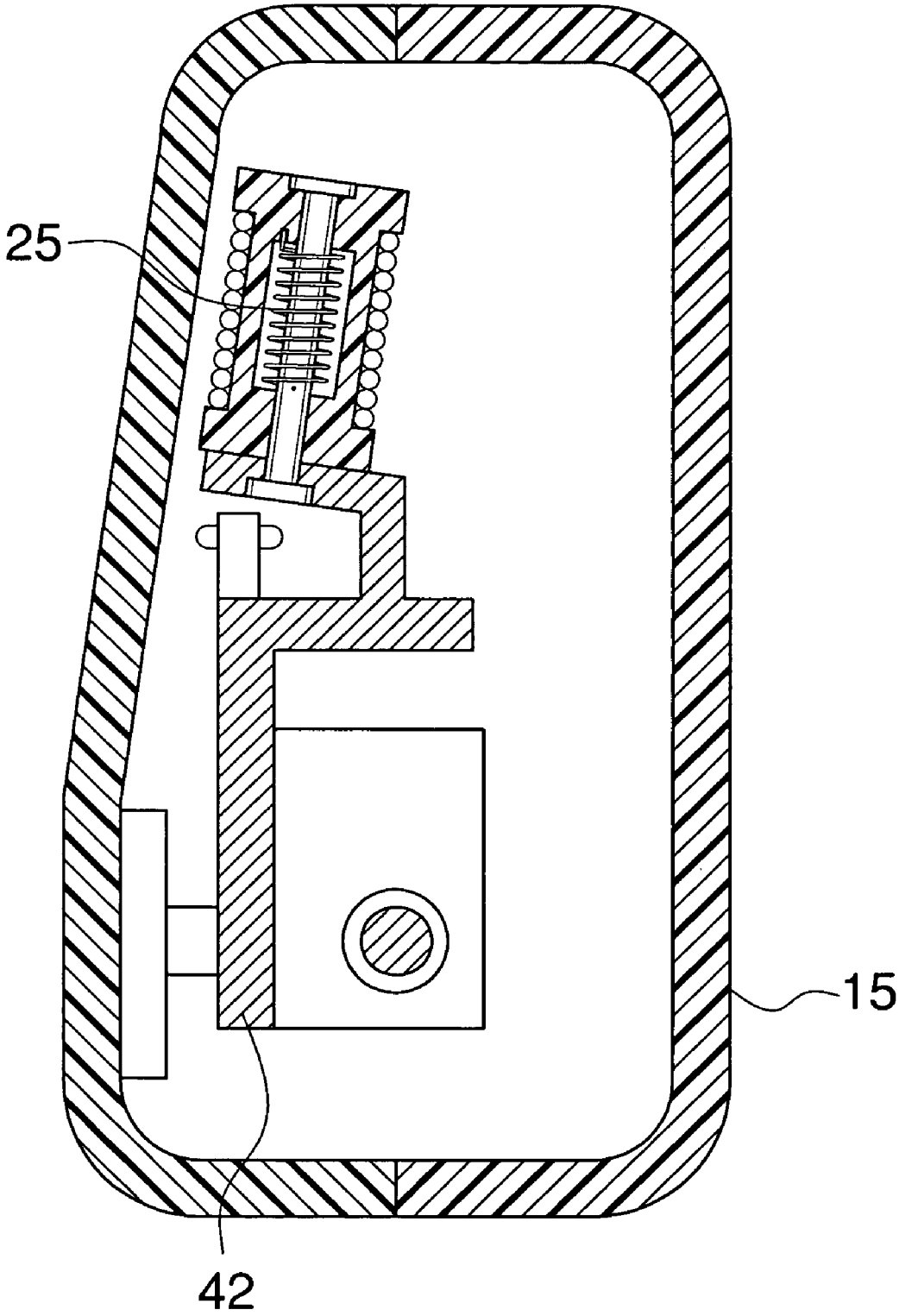
FIG. 4 is a cross-sectional view taken along line 4-4 of FIG. 3 of the present invention.
Figure 5:
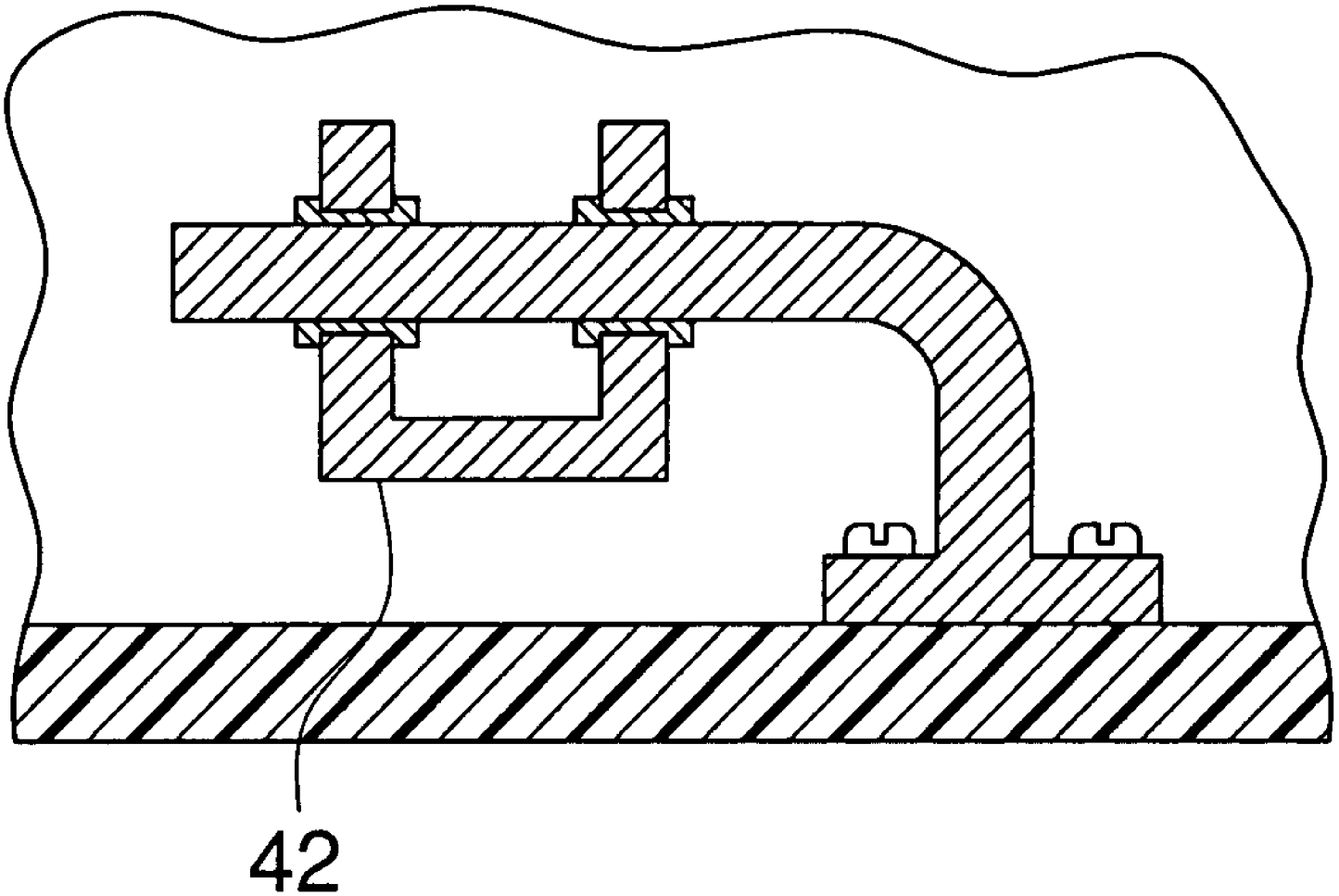
FIG. 5 is a cross-sectional view taken along line 5-5 of FIG. 3 of the present invention.
Figure 6:
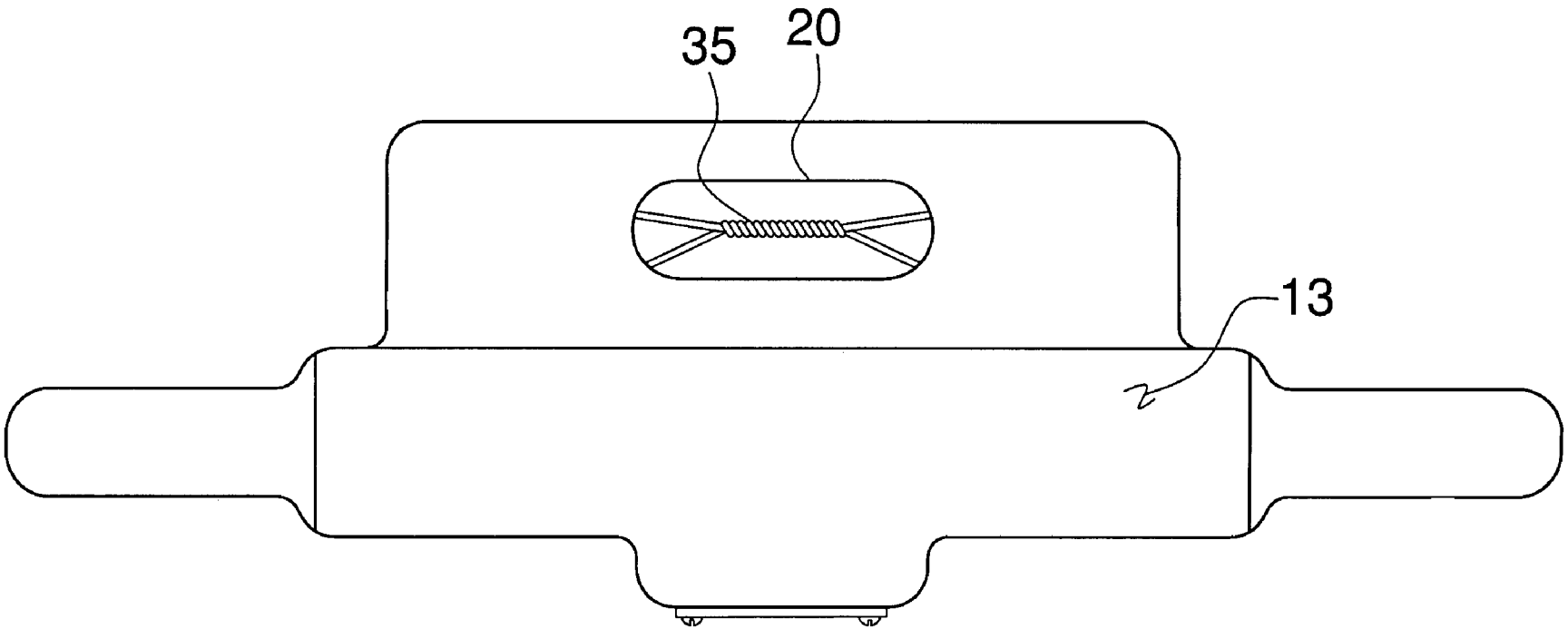
FIG. 6 is a front view of the present invention.

With reference now to the drawings, and in particular to FIGS. 1 through 6 thereof, a new hair removing device embodying the principles and concepts of the present invention and generally designated by the reference numeral 10 will be described.

As best illustrated in FIGS. 1 through 6, the hair removal apparatus 10 generally comprises a housing 12 that has a front wall 13, a back wall 14 and a peripheral wall 15 extending between the front 13 and back 14 walls. The peripheral wall 15 includes a top wall 16, a bottom wall 17, a first lateral wall 18 and a second lateral wall 19. The front wall 13 has an aperture 20 extending therethrough and an upper half of the front wall 13 is preferably angled back. The peripheral wall 15 has a break 21 therein so that the housing 12 may be opened up for accessing an interior of the housing 12.

Each of a pair of spools 23, 24 is rotatably mounted in the housing 12. The spools 23, 24 are positioned so that the aperture 20 is between the spools 23, 24. Each of the spools 23, 24 has a rotational axis orientated parallel with respect to each other. Biasing members 25, that are preferably springs coiled around spindles rotatably mounting each of the spools, rotationally bias the spools 23, 24 in opposite directions with respect to each other.

A first tether 30 is wound around a first spool 23 of the pair of spools 23, 24. The first tether 30 has a free end 31 secured adjacent to a second spool 24 of the pair of spools 23, 24. A second tether 32 is wound around the second spool 24. The second tether 32 extends away from the second spool 24 and is wound about the first tether 30 so that a plurality of loops 35 is defined. The loops 35 are positioned adjacent to the aperture 20. A free end 33 of the second tether 32 is secured adjacent to the first spool 23. The biasing members 25 pull the first 30 and second 32 tethers taut.

A drive assembly 40 is mechanically coupled to the first 23 and second 24 spools for selectively moving the first 23 and second 24 spools in a first direction away from each other. The biasing members 25 move, or pull, the first 23 and second 24 spools in a second direction toward each other by pulling the tethers 30, 32 taught. The loops 35 twist with respect to each other when the first 23 and second 24 spools move in the first and second directions.

The drive assembly 40 includes a pair of slides 42 each slidably mounted in the housing 12. Each of the first 23 and second 24 spools is attached to one of the slides 42. The slides 42 are selectively movable toward and away from the first 18 and second 19 side walls of the housing 12. A motor 43 is mounted in the housing 12 and is positioned between the slides 42. Each of a pair of push rods 44 is attached to one of the slides 42 and each extends toward the motor 43. The rods 44 each have a proximal end 45 with respect to the motor 43. Each of a pair of cams 46 is attached to the motor 43. The cams 46 each abut one of the proximal ends 45. The cams 46 selectively urge the rods 44 away from the motor 43 when the motor 43 rotates the cams 46. A power supply 47 is electrically coupled to the motor 43. The power supply 47 preferably comprises at least one battery that is removably positioned in the housing 12. A door 48 in the housing 12 allows for access to the battery. An actuator 49 is operationally coupled to the motor 43 for selectively turning the motor 43 on or off. The actuator 49 is mounted on the housing 12. Each of a pair of handles 50 is attached to the housing. Each of the handles 50 is attached to one of the first 18 and second 19 side walls and extends away therefrom.

In use, the front wall 13 is placed against the skin so that the skin forms a bulbous mound extending into the aperture 20. The motor 43 is turned on and the housing 12 is moved along the skin. The back and forth movement of the spools 23, 24 with respect to the aperture 20 causes the spools 23, 24 to rotate slightly and to cause the loops to twist. The tightening and loosening of the tethers 30, 32, enhances the twisting movement of the loops 35. The twisting motion of the loops 35 causes them to engage, or entangle, with hairs on the skin. As the loops 35 twist, the hair is pulled out at its roots and thereby removes the hair from the skin.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A hair removal device comprising:

a housing having a front wall, a back wall and a peripheral wall extending between said front and back walls, said front wall having an aperture extending therethrough;

a pair of spools being rotatably mounted in said housing and positioned such that said aperture is between said spools, each of said spools having a rotational axis orientated parallel with respect to each other, biasing members rotationally bias said spools in opposite directions with respect to each other;

a first tether being wound around a first spool of said pair of spools, said first tether having an end secured adjacent to a second spool of said pair of spools;

a second tether being wound around said second spool, said second tether extending away from said second spool and being wound about said first tether and defining a plurality of loops, said loops being positioned adjacent to said aperture, an end of said second tether being secured adjacent to said first spool, wherein said biasing members pull said first and second tethers taut;

a drive assembly being mechanically coupled to said first and second spools for selectively moving said first and second spools in a first direction away from each other, said biasing members moving said first and second spools in a second direction toward each other, wherein said loops twist with respect to each other when said first and second spools move in said first and second directions; and wherein said loops may be selectively positioned against skin such that said loops engage and remove hair attached to the skin.

2. The device according to claim 1, wherein said peripheral wall includes a top wall, a bottom wall, a first lateral wall and a second lateral wall, a pair of handles being attached to said housing, each of said handles being attached to one of said first and second lateral walls and extending away therefrom.

3. The device according to claim 1, wherein said peripheral wall includes a top wall, a bottom wall, a first lateral wall and a second lateral wall, wherein drive assembly includes:

a pair of slides each slidably mounted in said housing, each of said first and second spools being attached to one of said slides, said slides being selectively movable toward and away from said first and second side walls of said housing;

a motor being mounted in said housing and being positioned between said slides;

a pair of push rods, each of said rods being attached to one of said slides and extending toward said motor, each of said rods having a proximal end with respect to said motor; and a pair of cams, each of said cams being attached to said motor, each of said cams abutting one of said proximal ends, wherein said cams selectively urge said rods away from said motor when said cams are rotated by said motor.

4. The device according to claim 3, wherein said drive assembly further includes a power supply being electrically coupled to said motor.

5. The device according to claim 4, wherein said power supply comprises at least one battery being removably positioned in said housing.

6. The device according to claim 3, wherein said drive assembly further includes an actuator being operationally coupled to said motor for selectively turning said motor on or off, said actuator being mounted on said housing.

7. A hair removal device comprising:

a housing having a front wall, a back wall and a peripheral wall extending between said front and back walls, said peripheral wall including a top wall, a bottom wall, a first lateral wall and a second lateral wall, said front wall having an aperture extending therethrough;

a pair of spools being rotatably mounted in said housing and positioned such that said aperture is between said spools, each of said spools having a rotational axis orientated parallel with respect to each other, biasing members rotationally bias said spools in opposite directions with respect to each other;

a first tether being wound around a first spool of said pair of spools, said first tether having an end secured adjacent to a second spool of said pair of spools;

a second tether being wound around said second spool, said second tether extending away from said second spool and being wound about said first tether and defining a plurality of loops, said loops being positioned adjacent to said aperture, an end of said second tether being secured adjacent to said first spool, wherein said biasing members pull said first and second tethers taut;

a drive assembly being mechanically coupled to said first and second spools for selectively moving said first and second spools in a first direction away from each other, said biasing members moving said first and second spools in a second direction toward each other, wherein said loops twist with respect to each other when said first and second spools move in said first and second directions, said drive assembly including;

a pair of slides each slidably mounted in said housing, each of said first and second spools being attached to one of said slides, said slides being selectively movable toward and away from said first and second side walls of said housing;

a motor being mounted in said housing and being positioned between said slides;

a pair of push rods, each of said rods being attached to one of said slides and extending toward said motor, each of said rods having a proximal end with respect to said motor;

a pair of cams, each of said cams being attached to said motor, each of said cams abutting one of said proximal ends, wherein said cams selectively urge said rods away from said motor when said cams are rotated by said motor;

a power supply being electrically coupled to said motor, said power supply comprising at least one battery being removably positioned in said housing;

an actuator being operationally coupled to said motor for selectively turning said motor on or off, said actuator being mounted on said housing;

a pair of handles being attached to said housing, each of said handles being attached to one of said first and second lateral walls and extending away therefrom; and wherein said loops may be selectively positioned against skin such that said loops engage and remove hair attached to the skin.

* * * * *